US006505559B1

(12) United States Patent
Joslin et al.

(10) Patent No.: US 6,505,559 B1
(45) Date of Patent: Jan. 14, 2003

(54) WELL BORE CUTTING AND PERFORATING DEVICES AND METHODS OF MANUFACTURE

(75) Inventors: Johnny Joslin, Godley, TX (US); David S. Wesson, Fort Worth, TX (US); Dan W. Pratt, Fort Worth, TX (US)

(73) Assignee: Owen Oil Tools, Inc., Fort Worth, TX (US)

( * ) Notice: Subject to any disclaimer, the term of this patent is extended or adjusted under 35 U.S.C. 154(b) by 6 days.

(21) Appl. No.: 09/661,359

(22) Filed: Sep. 14, 2000

(51) Int. Cl.[7] ..... F42B 1/028

(52) U.S. Cl. ..... 102/310; 102/307; 102/312; 102/313; 86/50

(58) Field of Search ..... 86/50; 102/306, 102/307, 309, 310, 312, 313

(56) References Cited

U.S. PATENT DOCUMENTS 2,494,256 A * 1/1950 Muskat et al. ..... 102/310 X
2,980,018 A * 4/1961 Turechek ..... 102/309
3,013,491 A * 12/1961 Poulter ..... 102/309 X
3,053,182 A * 9/1962 Christopher ..... 102/307 X
3,233,688 A * 2/1966 Bell ..... 102/307 X
3,732,818 A * 5/1973 Thomanek ..... 102/306
3,949,674 A * 4/1976 Talley ..... 102/476
4,354,433 A 10/1982 Owen ..... 102/307
4,714,019 A * 12/1987 Lips et al. ..... 102/309 X
4,724,105 A * 2/1988 Owen ..... 102/310 X
5,046,563 A * 9/1991 Engel et al. ..... 102/310 X
5,377,594 A * 1/1995 Alford ..... 102/310 X
5,567,906 A * 10/1996 Reese et al. ..... 102/307 X
6,016,753 A * 1/2000 Glenn et al. ..... 102/309 X

* cited by examiner

*Primary Examiner*—Peter A. Nelson
(74) *Attorney, Agent, or Firm*—Bracewell & Patterson, LLP

(57) ABSTRACT

A tubing and casing cutter is shown which can be assembled in the field from a plurality of pressed segmented pellets of free standing explosive material. The segmented pellets have a liner glued to at least one exposed face thereof. The pellets are glued to a backup plate with two mirror image plates being stacked to form a plate assembly. A plurality of plate assemblies are stacked within a surrounding container to form the cutter. The pressed pellets can also be assembled within a cup-shaped container to form a shaped charge.

9 Claims, 2 Drawing Sheets

WELL BORE CUTTING AND PERFORATING DEVICES AND METHODS OF MANUFACTURE

BACKGROUND OF THE INVENTION

1. Field of the Invention

The present invention relates generally to improvements in charge segments formed of explosive materials which are assembled together to form a pipe cutting or severing apparatus or to form a shaped charge for perforating a well bore. The invention also pertains to methods of making pelletized charge segments of pressed explosive materials and to a method for assembling such charge segments into a pipe cutting, severing or perforating device.

2. Description of the Prior Art

A variety of tubing and casing cutters are known in the prior art for severing pipe, tubing and casing in oil and gas wells in order to allow retrieval of the pipe. One common cutter design involves the use of shaped charge wafers which are comprised of pressed explosive material, a liner and a backup plate of some material, typically steel material. This assembly is placed within a housing and is lowered down the well in order to cut the pipe.

U.S. Pat. No. 4,354,433, issued Oct. 19, 1982, to Owen shows another type of cutter in which an annular shaped charge is contained within a carrier and which is used as a pipe cutting or severing apparatus. The charge is made up of eight or more charge segments disposed in side to side butting relationship. Each charge segment has a die formed metal band and a charge load. The pipe cutting apparatus has the general configuration of a short cylinder or disk provided with a circumferential slot. The cutter is typically suspended within a pipe to be cut, in which case the charge segments are disposed to face radially outward.

The above described device to Owen thus uses "segments" that are assembled together in a housing, creating a system equivalent of the wafer type cutter in terms of explosive charge. The segmented cutter had certain advantages over the prior art in the manufacture of pipe cutting devices. In the prior art Owen cutter, the explosive segments were pressed and formed in one operation and then modified to fit the desired configuration of the cutter. This operation was all carried out at the manufacturing facility.

In the case of shaped charges which are used in well perforating operations, such charges are manufactured by pressing an explosive material between a cup-shaped case or container or a shaped charge liner. This operation can be done in a single stage or in multiple stages, but in all cases the explosive, case and liner are unitized at the manufacturing facility prior to shipment.

The present invention has as its object to provide an improved charge segment and assembly for cutting, severing or perforating pipe, casing and tubing, particularly pipe used in a well bore.

SUMMARY OF THE INVENTION

In the present method of manufacturing a well tubing and casing cutter, an explosive powder material is pressed to form a free standing segmented pellet having a desired shape and multiple faces. A liner is adhered to at least one face of the segmented pellet. A plurality of the pressed pellets are arranged in a circular pattern on a backup plate and are adhered to the backup plate to form a charge assembly. An ignition source is provided for the charge assembly with a plurality of the assemblies being stacked one upon the other within a container to form a well tubing and casing cutter.

The pressed pellets can be assembled on the backup plate at a location remote from the manufacturing facility where the pellets were pressed. Preferably, the tubing and casing cutter includes a central pelletized disk of explosive material with the plurality of pressed segmented pellets being arranged in a circular pattern about the pelletized disk on the backup plate. The disk and segmented pellets are adhered to the backup plate with a suitable glue or adhesive, each segmented pellet also having a liner adhered to at least one face thereof. The preferred glue used for securing the liner to the segmented pellets and for adhering the pellets and central disk to the backup plate is a silicone adhesive containing powdered copper.

A method for manufacturing a shaped charge is also shown. In this case, a plurality of segmented pellets are formed of a free standing pressed explosive powder material. The segmented pellets are arranged within a cup-shaped container. The assembly can be performed at a location remote from the manufacturing facility at which the pellets were pressed. The cup-shaped container has an interior for receiving the pellets and a mouth opening. The pressed segmented pellets are selectively sized to form a body which tapers inwardly toward the mouth opening of the cup-shaped body when the pellets are stacked one atop another. A V-shaped liner is positioned within the mouth opening of the container atop the stacked pressed pellets to complete the assembly.

Additional objects, features and advantages will be apparent in the written description which follows.

DETAILED DESCRIPTION OF THE INVENTION

Figure 5:
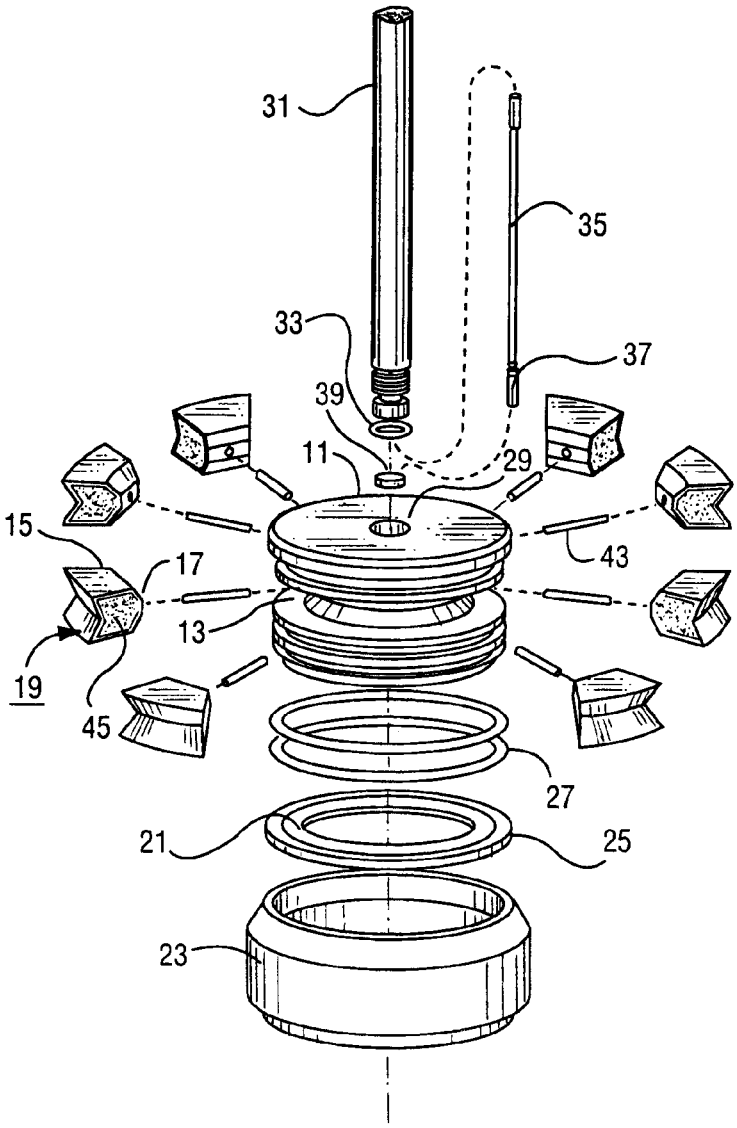
FIG. 5 PRIOR ART
FIG. 5 is an exploded, perspective view of a prior art tubing and casing cutter.

The advantages of the present invention can perhaps be best understood with reference to the prior art apparatus shown in FIG. 5 and assigned to the assignee of the present invention. The apparatus is adapted to be suspended within a pipe to be cut or severed. The apparatus comprises a carrier body 11 in the form of a one-piece disk having an outwardly facing circumferential slot or groove 13 that is shaped to conform to the shape of the side and end surfaces 15, 17 of the shaped charge segments 19. A sufficient number of shaped charge segments 19, typically eight or more, make up an annular shaped charge once the segments are assembled in the circumferential slot or groove 13 and are held in place by means of a resilient retainer ring 21.

An exterior cover ring 23 mates with the outer peripheral surface of the carrier body 11 and is held in place by an exterior cover keeper 25. O-rings 27 are provided to prevent fluid into the charge carrier interior. The carrier body 11 had a threaded axial bore 29 extending from one side face to the central region for receiving one end of an extension sleeve 31. O-ring 33 prevents fluid entry to the carrier body interior via bore 28. Detonating cord 35 is carried withing the extension sleeve 31 and terminates in a detonating fuse 37 which abuts an ignition pellet 39. The carrier body 11 has ignition passages 41 extending radially in the form of spokes from the bottom of the bore 29 to the end portion of each shaped charge segment 19. These passages receive the ignitor tubes 43.

In the prior art technique used for making these shaped charge segments, the steps can be summarized as:

(1) forming a strip of sheet metal material of a suitable length into a band;

(2) filling the band and pressing within the same a charge load;

(3) die forming said filled band into a shaped charged segment having a predetermined peripheral shape.

In practice, the band is typically provided as either a rectangular or cylindrical shape which is flatted on opposite sides so as to pass easily between the side walls of a mould or die cavity. Alternatively, the band may be originally formed to have mutually parallel opposite sidewalls spaced apart so as to pass easily between the mould or die cavity sidewalls. In either case, the next step is to load and press the explosive charge material into the band so that the open side faces of the charge material or charge load 45 are planar and coextensive with the opened side edge faces of the band.

Next the band with its charge load is placed in the cavity of a mould or die (not shown). The cavity has a bottom surface shaped to conform with the desired shape of the bottom surface of the finished shape charge segment and has a pair of side surfaces which are spaced and shaped to conform with the desired shape and dimensions of the side surfaces of the finished shape charge segment. The mould or die is provided with a ram portion which is reciprocal within the die cavity. The ram portion has a lower end surface which is shaped to conform with the desired shape of the active face of the finished shaped charge segment. The ram portion is actuated to preform its strokes so is to form the shaped charge segment 19 into its finished peripheral shape (see FIG. 5).

In a typical case, for a 3⅝ inch O.D. charge carrier having a slot or groove that is 1 1/32 inches wide, the shaped charge segment may have end surfaces forming a "V" and a charge load of 14.0 grams; in which case the finished peripheral length, and consequently the length of the rectangular strip will be about 4.0 inches. In the typical case, eight shaped charged segments would be used and the width of the rectangular strip would be about 1 inch with the open sides of the finished shaped charge segment being tapered to an angle of slightly less than 45 degrees.

One limitation in the devices of the prior art is that certain of the devices could not be shipped as a class C (1.4 S) material by air. There is a limitation on shipping explosives of the above type which exceed 22.7 grams in weight. For devices over this weight, a rating of class A (1.1 D) increases the cost of transportation significantly.

In the case of shaped charge perforating devices, the weight limitation to obtain the 1.4 S rating is a maximum of 39 grams of explosive.

Figure 1:
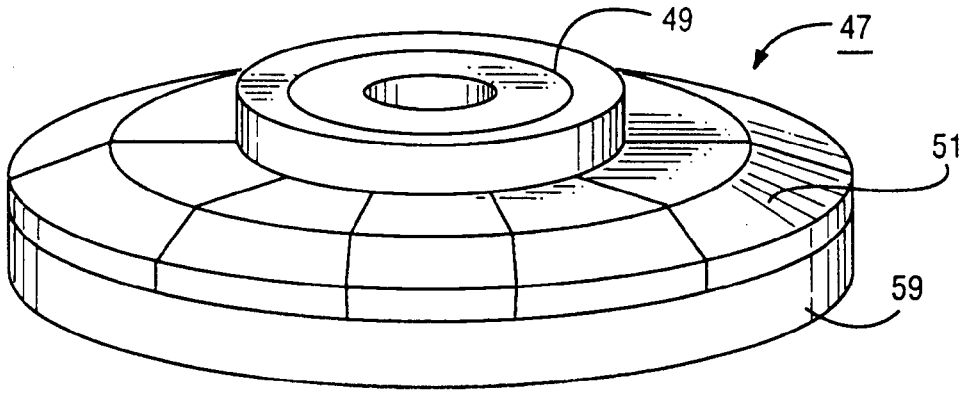
FIG. 1 is a perspective view of a charge assembly of the invention showing the backup plate, pressed segmented pellets and central pelletized disk used to form the assembly.

Turning to FIG. 1, there is shown a charge assembly 47 formed according to the method of the present invention. The charge assembly 47 is manufactured by first pressing an explosive powder material to form a pelletized disk 49 of explosive material. The explosive materials can be those commonly utilized in the trade and sold under the trade names RDX HMX and HNS. The explosive material is pressed under sufficient pressure to provide a free standing "disk" of the desired configuration.

Figure 2A:
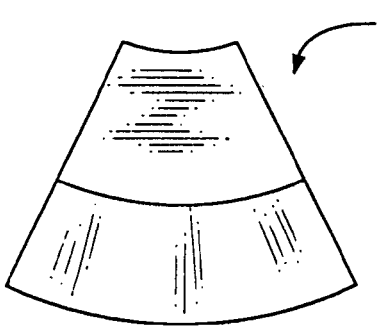
FIG. 2A is a top, isolated view of one segmented pellet used to form the assembly of FIG. 1.
Figure 2B:
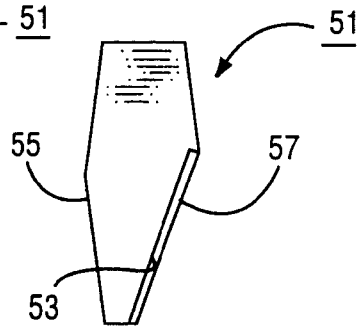
FIG. 2B is a side view of the isolated pellet of FIG. 2A.

The charge assembly 47 also includes a plurality of segmented pellets 51 which, as shown in FIGS. 2A and 2B, are wedged pie shaped members. The segmented pellets 51 are also formed by pressing the same type explosive powder under sufficient pressure to provide a free standing "pellet" of the desired configuration. Each segmented pellet 51 has a desired shape and multiple faces such as the lower face 53 and the upper face 55 shown in FIG. 2B. A metal liner 57 is adhered to at least one face of each segmented pellet 51. In this case, the liner 57 is adhered to the bottom angular surface 53. The liner is preferably in intimate contact with the segmented pellet 51 and is adhered by means of a suitable glue or adhesive. The preferred adhesive is a blend of commercially available silicone adhesive such as the silicone adhesive sold under the trademark VHT in which is disbursed copper powder. The liner 57 is typically formed of a metal, such as steel.

Figure 3:
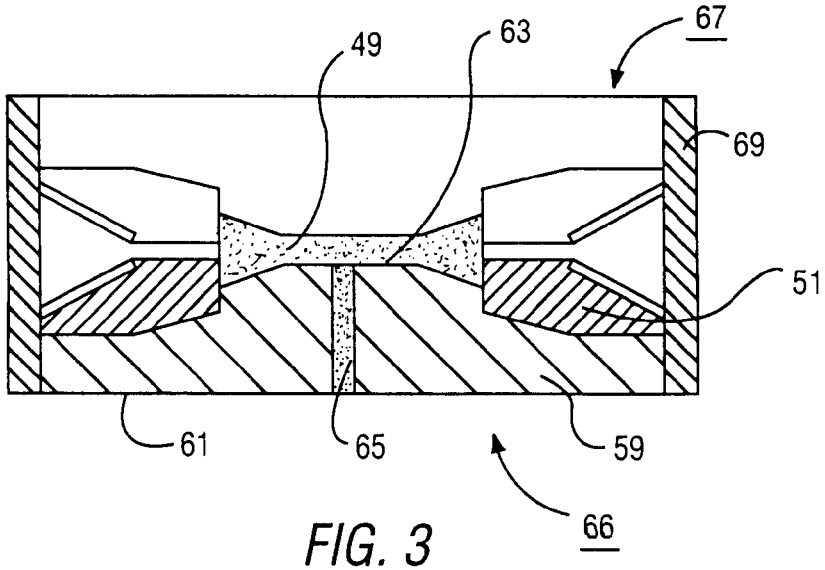
FIG. 3 is a side, cross-sectional view of a pair of stacked charge assemblies located within a surrounding container used to form the tubing and casing cutter of the invention.

As shown in FIG. 1, a plurality of the pressed segmented pellets 51 are arranged in a circular pattern about the pelletized disk 49 on a backup plate 59. The backup plate 59 is formed from a metal, such as steel or a hardened plastic. As shown in FIG. 3, the backup plate 59 has a flat back surface 61 and an internal profile 63 for receiving the disk 49 and segmented pellets 51. A central bore 65 is provided to receive an explosive or detonating cord in order to provide a source of ignition for the charge assembly.

As shown in FIG. 3, a second charge assembly designated generally as 67 which is a mirror image of the first charge assembly 66 is assembled within the container 69 to form a shaped charge cutter. A plurality of charge assemblies can be stacked one atop another within the container 69. The assembly of the first and second charge assemblies 66, 67 creates an annular V-shaped recess 71 about a periphery of the charge assemblies.

Figure 4:
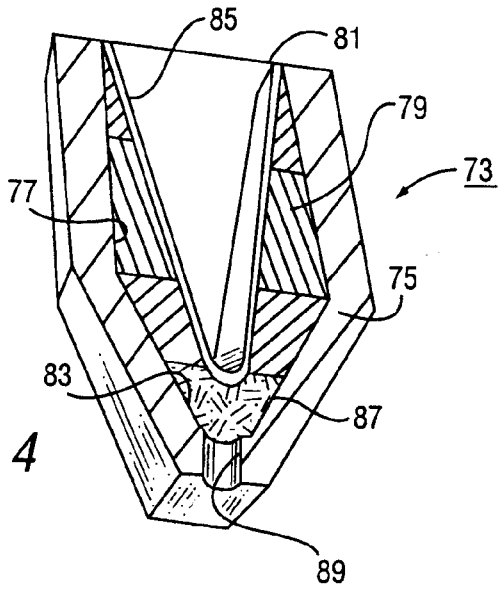
FIG. 4 is a side, partial cross-sectional view of a shaped charge using the pressed segmented pellets of the invention.

FIG. 4 shows a shaped charge of the type used in well perforating operations designated generally as 73. The shaped charge 73 includes a cup-shaped container 75 typically formed of a metal such as steel. The cup-shaped container 75 has an interior 77 for receiving pressed segmented pellets 79 and has a mouth opening 81. The pressed segmented pellets 79 are selectively sized to form a body which tapers inwardly from the bottom region 83 toward the mouth opening 81 thereof when the pellets 79 are stacked one atop another. A V-shaped liner 85 is positioned within the mouth opening 81 of the container 75 atop the stacked pressed pellet 79, the liner also typically being formed of metal. The bottom region 83 of the cup-shaped container typically holds a quantity of explosive powder 87 which is ignited by a suitable ignition means communicated through the bore 89 in conventional fashion.

An invention ha s been provided with several advantages. The pressed charge segments can be individually manufactured in a manner that gives better control over parameters such of uniformity of thickness of the shaped charge active face surface, the geometry of the charge shape and uniformity of charge load density. Such pressed charge pellets also have the further advantage that none of the individual pellets has a charge load that exceeds the maximum weight (350 grains or 22.7 grams in the case of a pipe cutter) for shipment of explosives via commercial airline carriers. Likewise, the charge segments used to assemble a shaped charge (such as charge 73 in FIG. 4) do not individually exceed 39 grams.

The various materials that are commonly utilized in the manufacture of the apparatus of the invention are well known and commercially available from a number of sources. The preferred material for the shaped charge segment band is dead soft copper, and the preferred charge materials are those commonly known in the trade as RDX, HMX and HNS.

Both versions of the invention utilize pressed pelletized explosives that can be assembled in the field allowing the products to meet all aspects of the 1.4 S classification regardless of the products final, assembled explosive loading. The "pellets" of explosive material can be pressed in any desired configuration. Field assembly not only simplifies shipping regulations but highly simplifies the product classification.

While the invention has been shown in only two of its forms, it is not this limited but is susceptible to various changes and modifications without departing from the spirit thereof.

What is claimed is:

1. A method of manufacturing a well tubing and casing cutter, the method comprising the steps of:

pressing an explosive powder material to form a plurality of free standing segmented pellets each having a wedged pie shape and multiple faces;

adhering a liner to at least one face of each segmented pellet;

providing a backup member;

arranging a plurality of the pressed pellets in a circular pattern on the backup member and adhering the pellets to the backup member with a suitable glue to form a charge assembly;

providing an ignition source for charge assembly; and assembling a plurality of the charge assemblies within a container to form a well tubing and casing cutter.

2. The method of claim 1, wherein the pressed pellets are assembled on the backup member at a location remote from a manufacturing facility where the pellets are pressed.

3. The method of claim 1, wherein the pressed segmented pellets have a liner glued to at least a selected face thereof.

4. A method of manufacturing a well tubing and casing cutter, the method comprising the steps of:

pressing an explosive powder material to form a pelletized disk of explosive material;

pressing an explosive powder material to form a plurality of segmented pellets, each segmented pellet having a desired shape having multiple faces;

adhering a liner to at least one face of each segmented pellet;

providing a backup member;

arranging a plurality of the pressed segmented pellets in a circular pattern about the pelletized disk on the backup member and adhering the pelletized disk and segmented pellets to the backup member with a suitable glue to form a charge assembly;

providing an ignition source for charge assembly; and assembling a plurality of the charge assemblies within a container to form a well tubing and casing cutter.

5. The method of claim 1, wherein the backup member is formed from a material selected from the group consisting of metals, hardened plastics, ceramics and rigid and semi-rigid materials.

6. A method of manufacturing a well tubing and casing cutter, the method comprising the steps of:

pressing an explosive powder material to form free standing segmented pellets having a desired shape and multiple faces;

adhering a liner to at least one face of each segmented pellet;

providing a backup member;

arranging a plurality of the pressed pellets in a desired pattern on the backup member and adhering the pellets to the backup member to form a charge assembly;

providing an ignition source for charge assembly;

assembling a plurality of the charge assemblies within a container to form a well tubing and casing cutter;

wherein the pressed segmented pellets have a liner glued to at least a selected face thereof; and wherein the glue used for securing the liner to the segmented pellets is an adhesive composition containing powdered copper.

7. The method of claim 6, wherein the adhesive is a silicone adhesive.

8. The method of claim 4, wherein the glue which is used to adhere the pelletized disk and pellet segments to the backup member comprises a silicone adhesive containing powdered copper.

9. The method of claim 4, wherein the backup member is formed from a material selected from the group consisting of metals, hardened plastics, ceramics and rigid and semi-rigid materials.

* * * * *